US010226678B1

(12) United States Patent
de Schipper et al.

(10) Patent No.: US 10,226,678 B1
(45) Date of Patent: Mar. 12, 2019

(54) ACTION SKILL TOY

(71) Applicant: Yulu International Limited, North Point (HK)

(72) Inventors: Johannes Marinus Thijmen de Schipper, Sai Ying Pun (HK); Jochem Gradus van Rijn, Kowloon (HK)

( * ) Notice: Subject to any disclaimer, the term of this patent is extended or adjusted under 35 U.S.C. 154(b) by 0 days.

(21) Appl. No.: 15/859,657

(22) Filed: Dec. 31, 2017

(51) Int. Cl.
*A63B 67/08* (2006.01)
*A63B 65/08* (2006.01)

(52) U.S. Cl.
CPC ..... *A63B 67/08* (2013.01); *A63B 65/08* (2013.01)

(58) Field of Classification Search
CPC ..... A63B 67/08; A63B 65/00; A63B 65/08; A63H 33/18; B26B 1/02; B26B 1/04; B26B 1/10
See application file for complete search history.

(56) References Cited

U.S. PATENT DOCUMENTS 93,249 A 8/1869 Trebe
508,273 A * 11/1893 Brauch ..... B26B 1/04 30/153
512,818 A * 1/1894 Hall ..... A47J 43/26 30/120.4
672,099 A 4/1901 Jackson
692,608 A * 2/1902 Bristow ..... A63B 65/08 446/36
770,118 A * 9/1904 Rowland ..... B26B 1/04 30/153
778,684 A * 12/1904 Lewis ..... B26B 1/04 30/153
847,206 A * 3/1907 Saunderson ..... B26B 1/04 30/153
881,294 A * 3/1908 Billings ..... B26B 1/02 30/153
1,932,943 A 10/1933 Smith
2,361,988 A * 11/1944 Bonnifield ..... A63B 65/08 473/590
4,364,174 A * 12/1982 De Asis ..... B26B 1/10 30/153
4,470,327 A * 9/1984 Gerber, Jr. ..... B26B 3/00 30/344
D285,812 S * 9/1986 Green, Jr. ..... 473/590
4,744,272 A 5/1988 Leatherman
4,856,793 A * 8/1989 Hannifin ..... A63B 65/08 446/47
4,878,868 A 11/1989 Shaw
(Continued)

*Primary Examiner* — Steven Wong
(74) *Attorney, Agent, or Firm* — LaMorte & Associates, P.C.

(57) ABSTRACT

An action skill toy that is intended to be juggled by being repeatedly thrown and caught in one hand or between both hands of a user. The action skill toy has a central hub area and rigid appendages that extend away from the central hub area. Each of the rigid appendages has a first end within the central hub area and a free second end that extends out of the central hub area. Each of the rigid appendages is coupled at a pivot joint to another of appendages within the central hub area. This enables each of the rigid appendages to rotate about a pivot joint in a common plane of rotation. To facilitate the grasping of the rigid appendages during juggling, each of the appendages has an enlarged area near its free end. The enlarged areas also provide space for the mounting of illumination units.

12 Claims, 7 Drawing Sheets

(56) References Cited

U.S. PATENT DOCUMENTS

| | | | | | |
|---|---|---|---|---|---|
| 4,895,377 | A | | 1/1990 | Arbor | |
| 5,054,200 | A | * | 10/1991 | Davis, Jr. | B26B 27/00 30/152 |
| 5,906,529 | A | * | 5/1999 | Spais | A63B 65/08 446/36 |
| 6,195,898 | B1 | * | 3/2001 | Lemisch | B26B 1/04 30/153 |
| 6,629,873 | B2 | | 10/2003 | Shaw | |
| 6,896,578 | B2 | | 5/2005 | Shaw | |
| 7,300,329 | B2 | | 11/2007 | Cohen | |
| 7,582,003 | B1 | * | 9/2009 | Trichak | A63H 33/18 446/219 |
| 7,676,930 | B1 | * | 3/2010 | Demko | B26B 1/04 30/153 |
| 2004/0187313 | A1 | * | 9/2004 | Zirk | B26B 1/04 30/123 |
| 2006/0094573 | A1 | | 5/2006 | Weck | |
| 2010/0034575 | A1 | * | 2/2010 | Colman | B43K 23/00 401/131 |
| 2014/0024482 | A1 | | 1/2014 | Smith | |
| 2014/0218895 | A1 | * | 8/2014 | Pino | B26B 11/008 362/120 |

* cited by examiner

ACTION SKILL TOY

BACKGROUND OF THE INVENTION

1. Field of the Invention

In general, the present invention relates to action skill toys that are designed to be juggled in one hand or to be juggled between the hands. More particularly, the present invention relates to action skill games that have rigid appendages that radiate from a common hub area.

2. Prior Art Description

There are many toys and novelty items that take practice and skill to operate. A prime example of such an action skill toy is the yo-yo. Such action skill toys require that the user develop the needed hand-eye coordination, muscle memory, and dexterity to correctly play with the toy.

Many action skill toys are intended to be juggled. That is, the toy is designed to be repeatedly thrown and caught either in the same hand or between hands. Juggling toys tend to balance about a central point so that the toy will spin predictably in the air when released from the juggler's hand. Such a balance is necessary to ensure that the toy will spin in a consistent manner each time it is caught and released. A complication occurs when the item being juggled is not ridged but has the ability to bend or fold. Items that bend or fold have a center of gravity that can change drastically depending upon the configuration of the item at a given point in time.

The present invention is an action skill toy that is intended to be juggled, yet has a changeable configuration that effects its center of gravity. The user must not only develop the skills needed to throw and catch the action skill toy but must also develop the skills to control the configuration of the toy in flight. In this manner, the flight path of the action skill toy can become predictable, yet changeable, between tosses. This enables a wide range of juggling effects and tricks to be achieved that are not possible using traditional ridged juggling toys. The improved action skill toy is described and claimed below.

SUMMARY OF THE INVENTION

The present invention is an action skill toy that is intended to be juggled by being repeatedly thrown and caught in one hand or between both hands of a user. The action skill toy has a central hub area and rigid appendages that extend away from the central hub area. It is the rigid appendages that are grasped by a user's hands. Each of the ridged appendages has a first end within the central hub area and a free second end that extends out of the central hub area. Each of the rigid appendages is coupled at a pivot joint to another of the appendages within the central hub area. This enables each of the rigid appendages to rotate about a pivot joint in a common plane of rotation.

To facilitate the grasping of the rigid appendages during juggling, each of the rigid appendages has an enlarged area near its free end. The enlarged areas enable the rigid appendages to be easily grasped. The enlarged areas also provide space for the mounting of illumination units. The illumination units automatically activate when the appendages are juggled and rotate in the common plane of rotation about the pivot joints.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention action skill toy can have a variety of shapes, only one exemplary embodiment of the action skill toy is illustrated and described. The exemplary embodiment is selected in order set forth one of the best modes contemplated for the invention. The illustrated embodiment, however, is merely exemplary and should not be considered a limitation when interpreting the scope of the appended claims.

Figure 1:
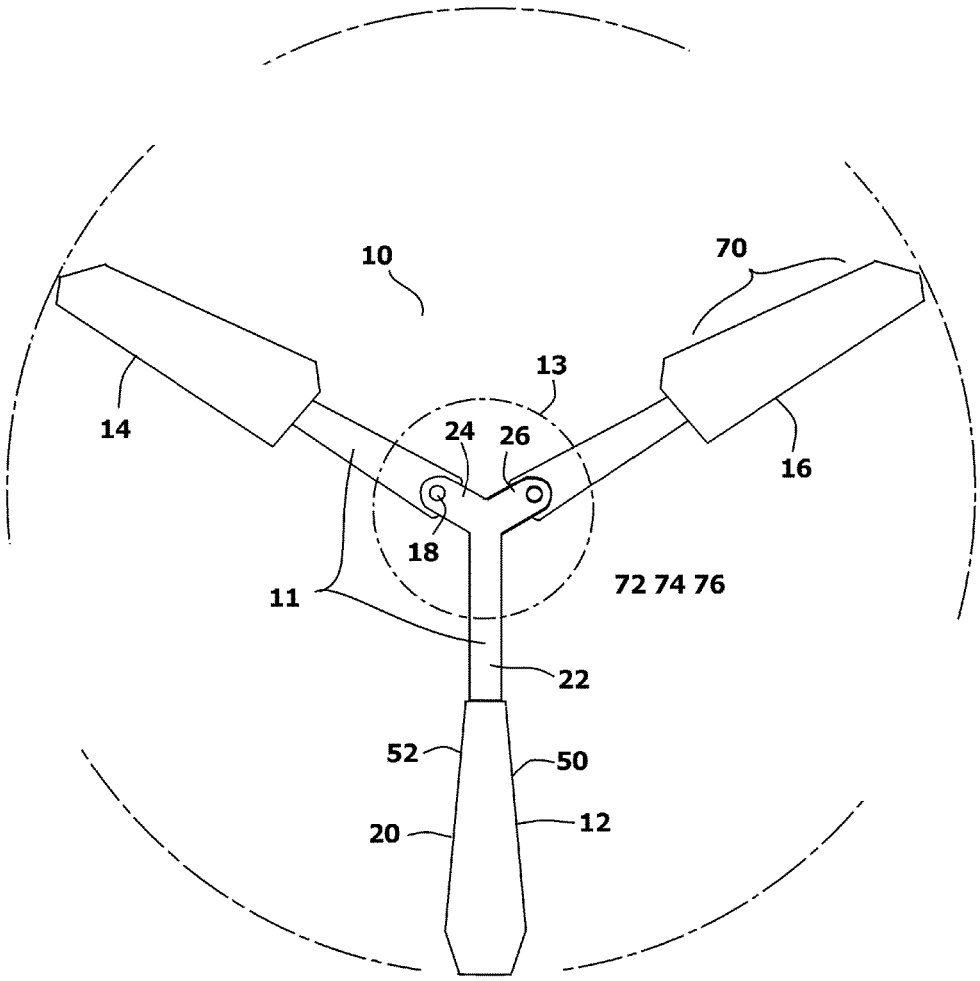
FIG. 1 is a front view of an exemplary embodiment of an action skill toy with its appendages configured in symmetrical positions.
Figure 2:
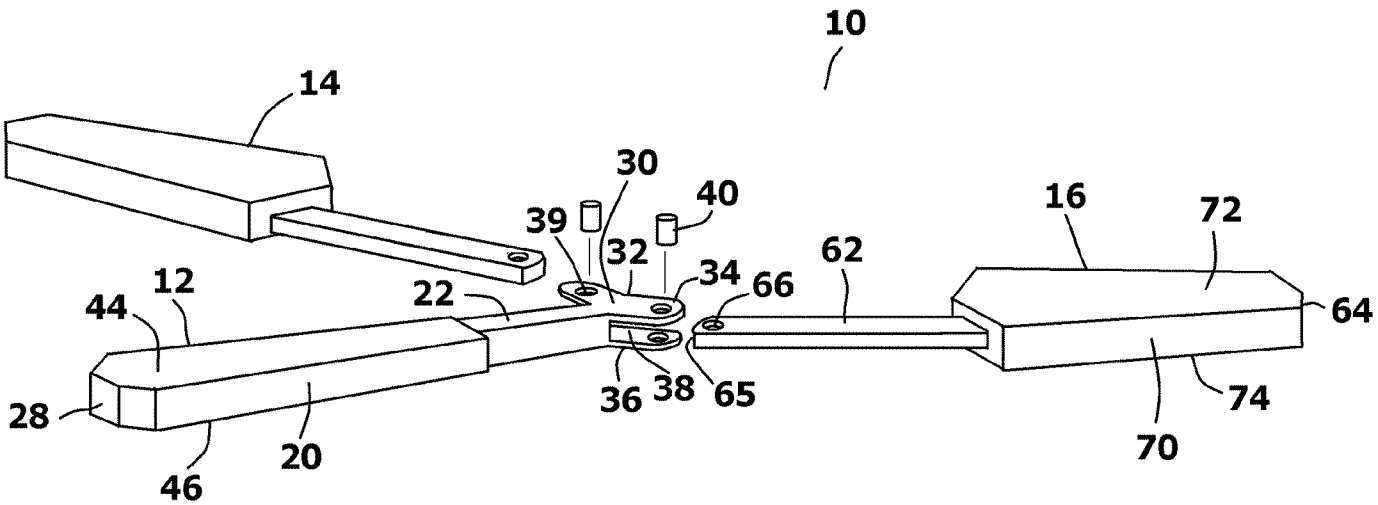
FIG. 2 is an exploded perspective view of the exemplary embodiment of the action skill toy.
Figure 3:
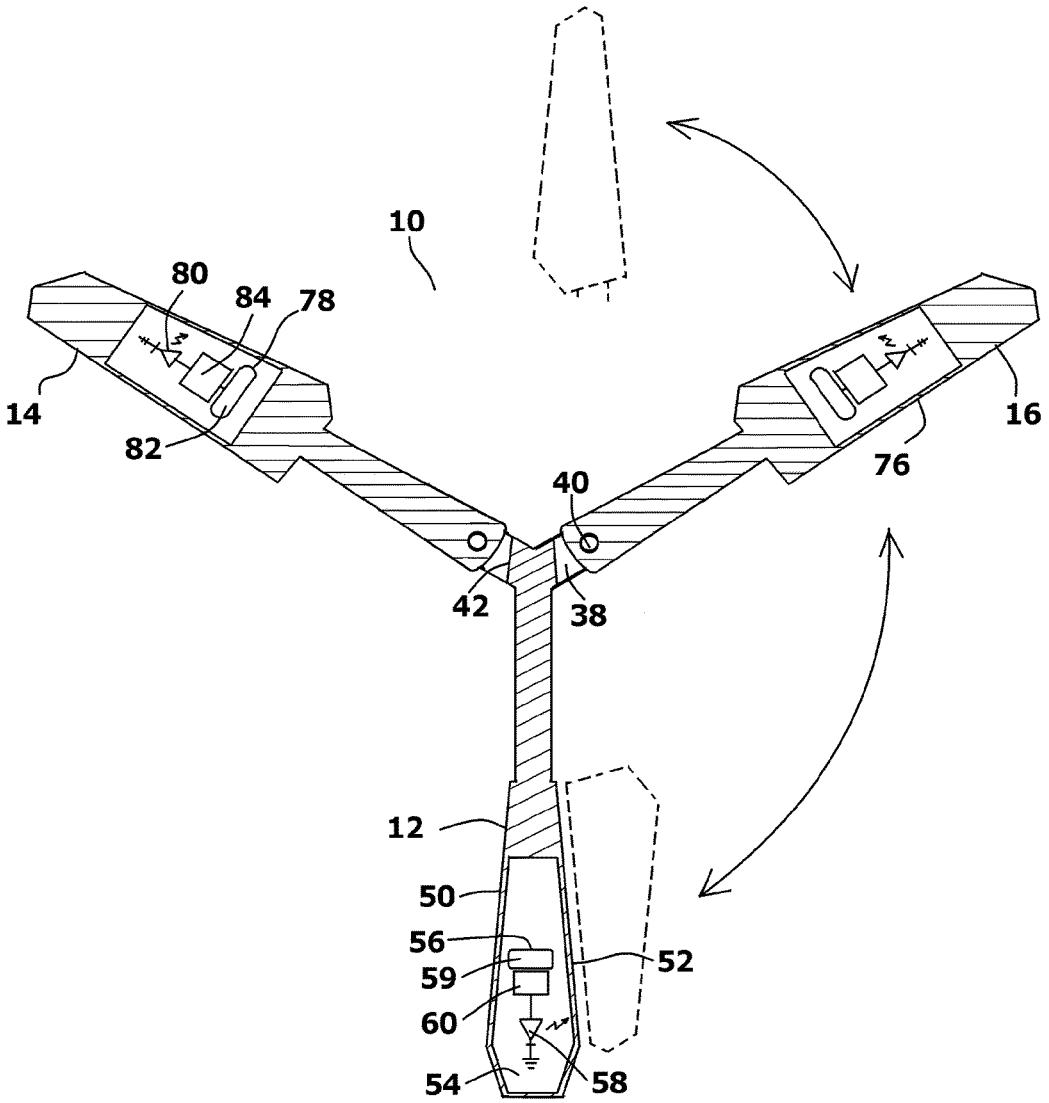
FIG. 3 is a cross-sectional view of the exemplary embodiment of FIG. 1.

Referring to FIG. 1 in conjunction with FIG. 2 and FIG. 3, an action skill toy 10 is presented. The action skill toy 10 is intended to be flipped, juggled and otherwise manipulated in the hands of a user. The action skill toy 10 has a plurality of appendages 11. The appendages 11 are rigid and all extend from a central hub area 13. When symmetrically oriented, as in FIG. 1, all the appendages 11 terminate at the same distance from the central hub area 13.

In the shown embodiment, the appendages 11 include a base appendage 12 and two arm appendages 14, 16. The two arm appendages 14, 16 attach to the base appendage 12 at hinged pivot joints 18 within the hub area 13. In this manner the arm appendages 14, 16 can rotate in a common plane about the pivot joints 18, relative the base appendage 12, through a wide range of motions.

As will be explained, all of the appendages 11 have enlarged areas 15 that extend outside of the hub area 13. The enlarged areas 15 are used to grab, catch and throw the action skill toy 10 during juggling and play. The appendages 11 can all be identical. However, in the shown embodiment, the appendages 11 have different shapes that enhance the play value of the action skill toy 10. For instance, certain juggling games may require that one of the appendages 11 not be touched as the action skill toy 10 is juggled.

The base appendage 12 is generally Y-shaped. That is, the base appendage 12 has an enlarged head 20, a shaft 22 that extends from the enlarged head 20, and two small hinge yokes 24, 26 that extend away from the shaft 22 at inclined angles. The enlarged head 20 and shaft 22 are linearly aligned between a jointed end 30 and a free end 28. The enlarged head 20 starts at the free end 28 and the shaft 22 terminates at the jointed end 30 in the crux of the overall Y-shape. Accordingly, at the jointed end 30, the hinge yokes 24, 25 and the shaft 22 diverge. The jointed end 30 of the base appendage 12 terminates on a rounded surface 32 that extends between the two sets of hinge yokes 24, 26. The rounded surface 32 forms a finger cradle within the hub area 13 that is disposed at or near the center of gravity of the action skill toy 10 when the arm appendages 14, 16 and the base appendage 12 are symmetrically disposed. The purpose of the rounded surface 32 is later explained.

Each of the hinge yokes 24, 26 is formed by two parallel panels 34, 36 that extend away from the shaft 22 in a common direction. The space between the parallel panels 34, 36 forms a slot 38. Holes 39 are formed in the parallel panels 34, 36 to receive a hinge pin 40. The slot 38 within each hinge yoke 24, 26 is open with the exception of a stop 42 that is purposely positioned to limit the rotational motion range of the arm appendages 14, 16.

The enlarged head 20 on the base appendage 12 has a face surface 44 and an opposite rear surface 46. The enlarged head 20 also has two long flat side surfaces 50, 52 that extend between the face surface 44 and the rear surface 46. As such, the two long flat side surfaces 50, 52 lay perpendicular to the common plane of rotation for the various appendages 11. The face surface 44 is translucent. An internal chamber 54 is defined within the enlarged head 20 between the face surface 44, the rear surface 46, and the two flat side surfaces 50, 52. This reduces the weight of the enlarged head 20 and provides room for a first internal illumination unit 56.

The illumination unit 56 contains at least one LED 58, a battery 59, and a logic circuit 60 capable of detecting motion. When the logic circuit 60 detects motion, the LED 58 is automatically activated for a short period of time. The light produced by the LED 58 is directed toward the translucent face surface 44. The face surface 44 is illuminated by the light and becomes highly visible to a person observing the action skill toy 10.

The arm appendages 14, 16 attach to the hinge yolks 24, 26 that extend from the jointed end 30 of the shaft 22. The two arm appendages 14, 15 have mirrored shapes. Each of the arm appendages 14, 16 has an arm shaft 62. The first end 64 of the arm shaft 62 has a hole 66 formed therethrough. The first end 64 of the arm shaft 62 fits into the slot 38 of either hinge yoke 24, 26. The hinge pin 40 passes through both the hinge yolks 24, 26 and the hole 66 in the arm shaft 22. This forms the pivot joints 18 that enable both the arm appendages 14, 16 and the base appendage 12 to move independently, as each can rotate about the pivot joint 18 in the common plane of rotation.

The free end 65 of the arm shaft 62 opposite the hole 66 terminates with an enlarged head 70. The enlarged head 70 is mostly hollow and has a front surface 72, a rear surface 74, and a flat side contact surface 76. The rear surface 74 of each enlarged head 70 is translucent to light. An internal illumination unit 78 is positioned within each of the enlarged heads 70. The illumination unit 78 contains at least one LED 80, a battery 82, and a logic circuit 84 capable of detecting motion. When the logic circuit 84 detects motion, the LED 80 automatically lights for a short period of time. The light produced by the LED 80 is directed toward the translucent rear surface 74. The rear surface 74 is internally illuminated by the light and becomes highly visible to a person observing the action skill toy 10.

Figure 4:
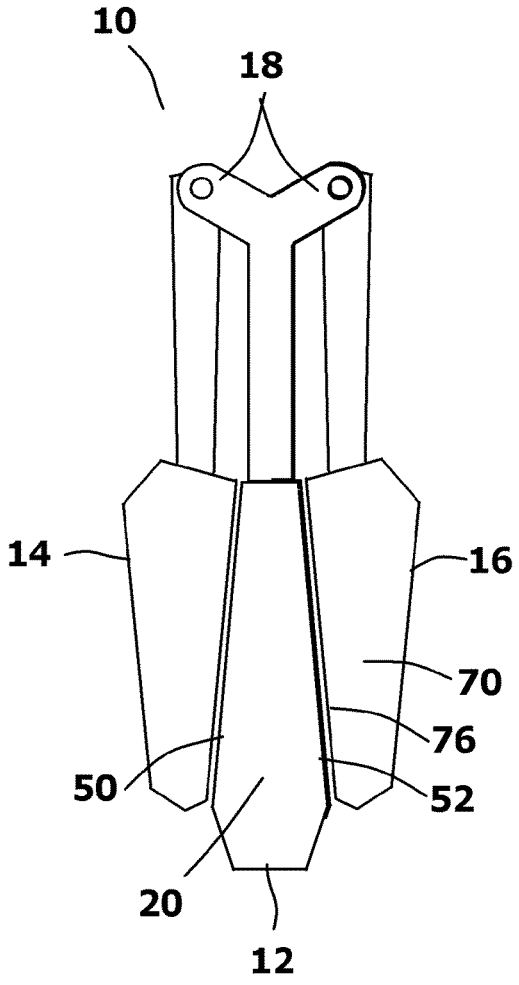
FIG. 4 shows the exemplary embodiment of the action skill toy shown in a first non-symmetrical configuration.

Referring to FIG. 4, it can be seen that the rotational range of movement provided to each of the arm appendages 14, 16 is limited. Any rotation toward the base appendage 12 is limited by the eventual contact with the base appendage 12. As the arm appendages 14, 16 rotate toward the base appendage 12, the side contact surfaces 76 on the enlarged heads 70 of the arm appendages 14, 16 abut flush against one of the flat side surfaces 50, 52 of the enlarged head 20. If contact is made at speed, a loud clap is produced as the two flat surfaces slap against each other.

Figure 5:
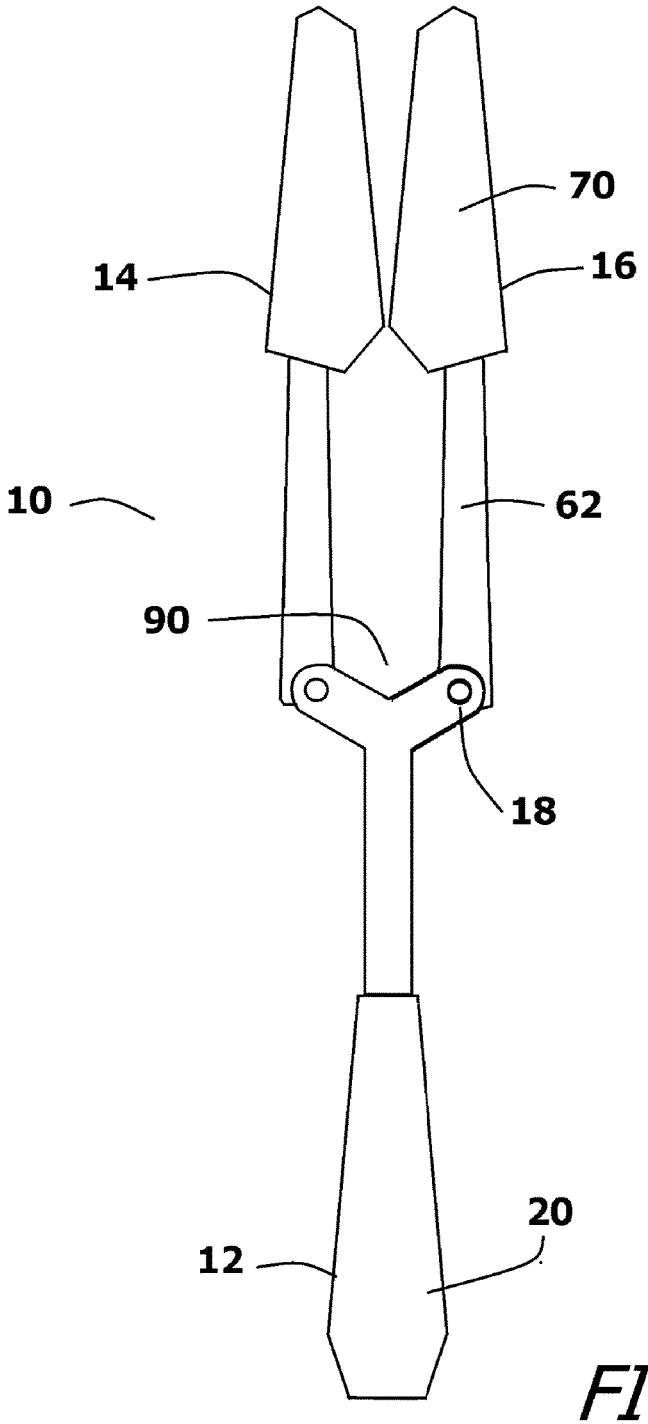
FIG. 5 shows the exemplary embodiment of the action skill toy shown in a second non-symmetrical configuration.

Referring to FIG. 5, it can be seen that the rotational movement of the arm appendages 14, 16 in the opposite direction is also limited. When rotating away from the base appendage 12, the arm shafts 62 of the arm appendages 14, 16 contact the stops 42 in the slot 38 of the hinge yokes 24, 26. This contact occurs when the arm shaft 62 is at or near a vertical orientation. Furthermore, should both the arm appendages 14, 16 be rotated away from the base appendage 12 at the same time, the two arm appendages 14, 16 will contact each other at the same moment the arm appendages 14, 16 contact the stops 42. As can be seen from FIG. 5, when both the arm appendages 14, 16 are at their highest rotation and contact one another, it is the enlarged heads 70 that come into contact. This leaves a finger gap 90 between the arm shafts 62 above the rounded surface 32 of the base appendage 12. The finger gap space 90 is large enough to accommodate an average sized finger without the finger being pinched between the arm shafts 62. This is an important feature during play.

Figure 6:
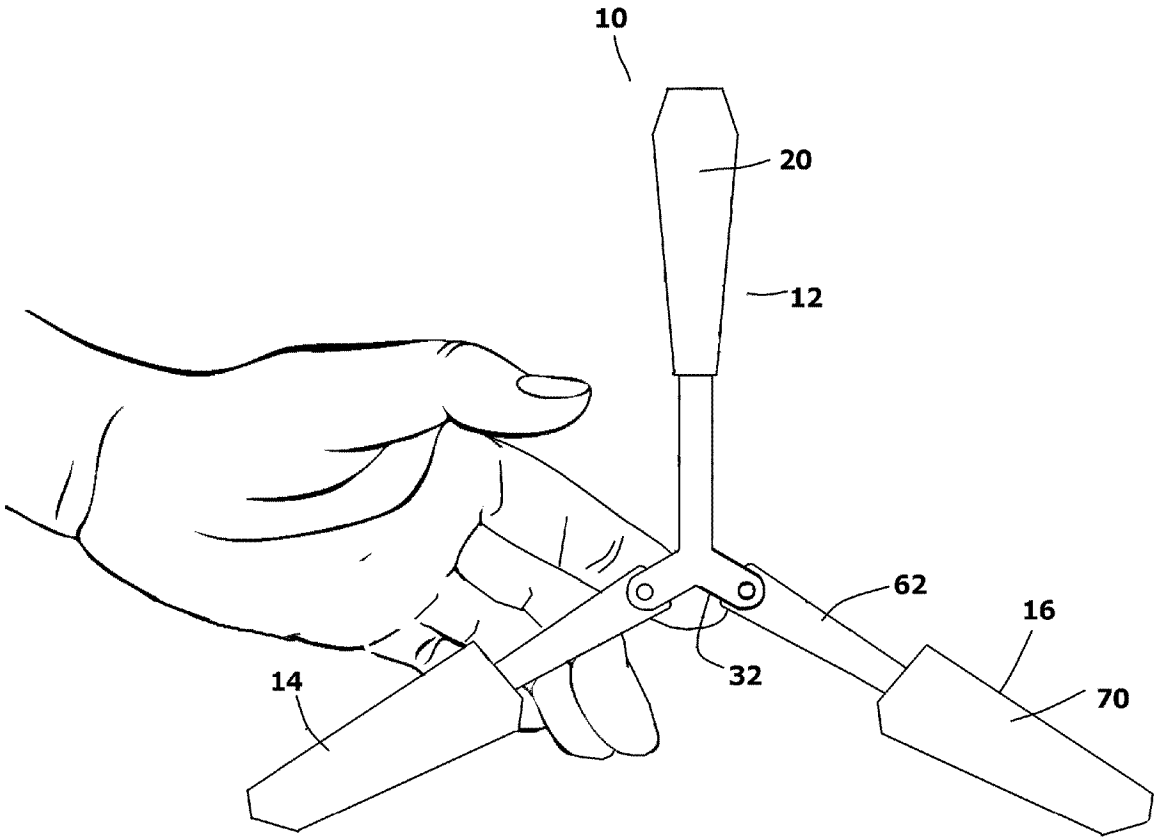
FIG. 6 shows the exemplary embodiment of the action skill toy being held in a user's hand.
Figure 7:
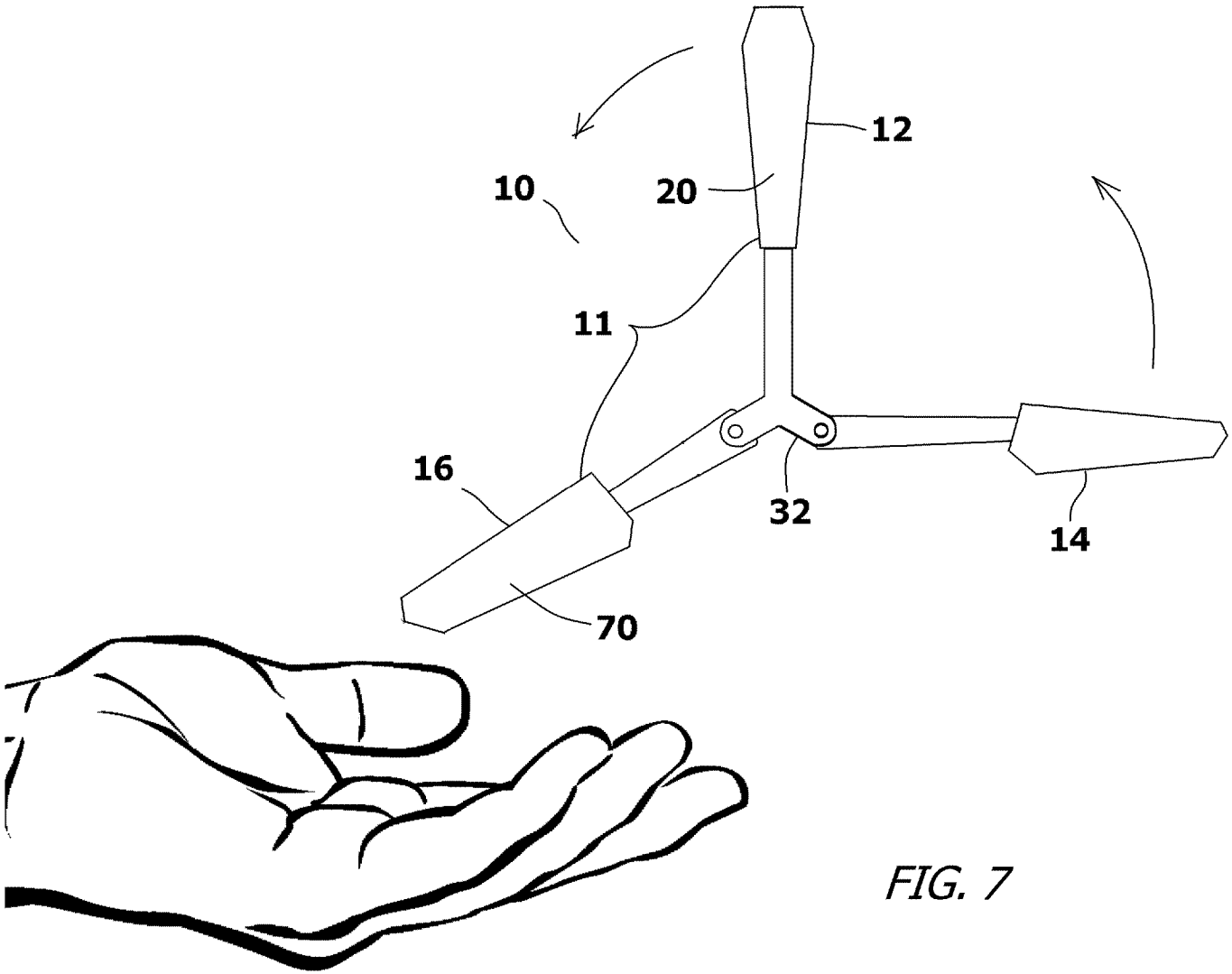
FIG. 7 show the exemplary embodiment of the action skill toy being tossed from a user's hand.

Referring to FIG. 6 and FIG. 7, it can be seen that the action skill toy 10 can be grasped along any appendage 11. In any grasp, the holder has the ability to place his/her finger against the rounded surface 32 of the base appendage 12. This position is in the hub area 13 and is at or near the center of gravity of the action skill toy 10 should the appendages 11 become equidistant. This enables the action skill toy 10 to be readily spun about a finger when performing juggling tricks with the action skill toy 10. Furthermore, it will be understood that as the action skill toy 10 is spun, thrown and caught, the enlarged head 20 and the enlarged heads 70 will internally illuminate, provided the base appendage 12 and arm appendages 14, 16 remain in motion.

It will be understood that the embodiment of the present invention that is illustrated and described is merely exemplary and that a person skilled in the art can make many variations to that embodiment. For instance, the shape and length of the base appendage 12 and the arm appendages 14, 16 can be changed as a matter of design choice. The base appendage 12 and the arm appendages 14, 16 can all be identical. Otherwise, a manufacturer may select a stylish form, where the base appendage 12 is a character and the arm appendages 14, 16 are the arms to that character. All such embodiments are intended to be included within the scope of the present invention as defined by the claims.

What is claimed is:

1. An action skill toy, comprising:

a hub area;

a plurality of rigid appendages that include a first appendage, a second appendage, and a third appendage, wherein each of said plurality of rigid appendages has a first end within said hub area and a free second end that extends out of said hub area, wherein said first appendage has two hinge yokes extending from said first end, therein providing said first appendage with a general Y-shape, wherein said second appendage and said third appendage are coupled to said hinge yokes of said first appendage with separate pivot joints, wherein each of said plurality of rigid appendages is coupled at a pivot joint to another of said plurality of rigid appendages within said hub area, therein enabling each of said rigid appendages to rotate about said pivot joint in a common plane of rotation, and wherein each of said plurality of rigid appendages has an enlarged area, proximate said second end; and an internal illumination unit disposed within said enlarged areas of at least one of said plurality of rigid appendages, wherein said internal illumination unit automatically illuminates when said plurality of rigid appendages rotate in said common plane of rotation about said pivot joints.

2. The action skill toy according to claim 1, wherein said action skill toy has a center of gravity within said hub area when said plurality of rigid appendages are symmetrically disposed in said common plane of rotation.

3. The action skill toy according to claim 1, wherein said enlarged area of said first appendage has a first flat side surface and an opposite second flat side surface that are perpendicular to said plane of rotation.

4. The action skill toy according to claim 3, wherein said enlarged area on said second appendage has a flat side surface that makes flush contact with said first flat side surface of said first appendage when said first appendage and said second appendage rotate into contact.

5. The action skill toy according to claim 3, wherein said enlarged area on said third appendage has a flat side surface that makes flush contact with said second flat side surface of said first appendage when said first appendage and said third appendage rotate into contact.

6. An action skill toy, comprising:

a base appendage having an enlarged head, a shaft that extends from said enlarged head, and two hinge yokes extending from said shaft;

two arm appendages, wherein each arm appendage has an enlarged head and an arm shaft that extends from said enlarged head, wherein each said arm shaft attaches to said hinge yokes on said base appendage with pivot joints that enable said arm appendages to rotate relative said base appendage in a common plane of rotation; and internal illumination units disposed within said enlarged head of said arm appendages, wherein said internal illumination units automatically illuminate when said arm appendages experience motion.

7. The action skill toy according to claim 6, wherein said enlarged head of said base appendage has flat side surfaces that are perpendicular to said plane of rotation.

8. The action skill toy according to claim 7, wherein said enlarged head on each of said arm appendages has flat sides that makes flush contact with said flat side surfaces of said base appendage when said arm appendages rotate into contact with said base appendage.

9. An action skill toy, comprising:

a central area;

a plurality of rigid appendages, wherein each of said plurality of rigid appendages has a first end within said central area and a free second end that extends out of said central area;

illumination units that are disposed within said enlarged area of each of said plurality of rigid appendages, wherein each of said plurality of rigid appendages is coupled at a pivot joint to another of said plurality of rigid appendages within said central area, therein enabling each of said rigid appendages to rotate about said pivot joint in a common plane of rotation, and wherein each of said plurality of rigid appendages has an enlarged area, proximate said second end.

10. The action skill toy according to claim 9, wherein said action skill toy has a center of gravity within said central area when said plurality of rigid appendages are symmetrically disposed in said common plane of rotation.

11. The action skill toy according to claim 9, wherein said plurality of rigid appendages includes a first appendage, a second appendage, and a third appendage.

12. The action skill toy according to claim 11, wherein said second appendage and said third appendage are both coupled to said first appendage with separate pivot joints.

* * * * *